US006581559B1

(12) United States Patent
Grob et al.

(10) Patent No.: US 6,581,559 B1
(45) Date of Patent: Jun. 24, 2003

(54) PULSE START METHOD AND PULSE START DEVICE FOR AN INTERNAL COMBUSTION ENGINE

(75) Inventors: Ferdinand Grob, Besigheim (DE); Peter Ahner, Boeblingen (DE); Manfred Ackermann, Oppenweiler (DE)

(73) Assignee: Robert Bosch GmbH, Stuttgart (DE)

( * ) Notice: Subject to any disclaimer, the term of this patent is extended or adjusted under 35 U.S.C. 154(b) by 26 days.

(21) Appl. No.: 09/868,966

(22) PCT Filed: Sep. 28, 2000

(86) PCT No.: PCT/DE00/03391

§ 371 (c)(1),
(2), (4) Date: Jun. 22, 2001

(87) PCT Pub. No.: WO01/38725

PCT Pub. Date: May 31, 2001

(30) Foreign Application Priority Data

Nov. 24, 1999 (DE) ..... 199 56 384

(51) Int. Cl.[7] ..... F02N 5/04
(52) U.S. Cl. ..... 123/179.3; 290/38 B
(58) Field of Search ..... 123/179.3, 179.4, 123/179.22; 290/31, 38 B

(56) References Cited

U.S. PATENT DOCUMENTS 6,098,584 A * 8/2000 Ahner et al. ..... 123/179.3
6,250,270 B1 * 6/2001 Ahner et al. ..... 123/179.3
6,453,863 B1 * 9/2002 Pels et al. ..... 123/179.3

FOREIGN PATENT DOCUMENTS

| | | | |
|---|---|---|---|
| DE | 27 48 697 A | | 5/1979 |
| DE | 30 26 569 A | | 2/1982 |
| DE | 196 45 943 A | | 5/1998 |
| DE | 198 17 497 A1 | * | 10/1999 |
| DE | 198 58 992 A | | 10/1999 |
| WO | WO-99/54620 | * | 10/1999 |

* cited by examiner

*Primary Examiner*—Henry C. Yuen
*Assistant Examiner*—Arnold Castro
(74) *Attorney, Agent, or Firm*—Michael J. Striker

(57) ABSTRACT

The invention relates to a pulse starting method for an internal combustion engine in which, during a wind-up phase, a flywheel mass is accelerated in a rotary driven fashion and then during a coupling phase, the rotating flywheel mass is coupled to a rotatably supported shaft of the engine, preferably the crankshaft, in order transmit torque, which is distinguished by the fact that during the wind-up phase (15) and/or the coupling phase (21, 22), the rotational speed progression of the flywheel mass (3) is evaluated, that based on this evaluation, a deduction is made as to whether a successful start of the engine (1) is possible, and that if a successful start is not expected, the shaft (2) is used to bring the engine (1) into an operating position that is favorable for a subsequent second starting attempt.

15 Claims, 2 Drawing Sheets

PULSE START METHOD AND PULSE START DEVICE FOR AN INTERNAL COMBUSTION ENGINE

BACKGROUND OF THE INVENTION

1. Field of the Invention

The invention relates to a pulse starting method for an internal combustion engine in which, during a wind-up phase, a flywheel mass is accelerated in a rotary driven fashion and then during a coupling phase, the rotating flywheel mass is coupled to a rotatably supported shaft of the engine, preferably the crankshaft, in order to transmit torque. It also relates to a pulse starter for performing the pulse starting method, which includes an electrical starter, which drives a rotatably supported flywheel mass, and having a starting control unit, which controls the starter and a pulse starting clutch.

2. Prior Art

A pulse starting method and a pulse starter for an internal combustion engine are known. In the pulse starting method, a flywheel mass is accelerated in a rotary driven fashion during a wind-up phase. This is achieved by means of an electrical starter. A pulse starting clutch disposed between the internal combustion engine and the flywheel mass is disengaged. The driving of the flywheel mass stores mechanical work. During a coupling phase in which the pulse starting clutch is engaged, the engine is cranked by this stored work, together with the driving torque of the starter. In comparison to a conventional start, in which the engine is cranked for a relatively long phase with a quasi-stationary rotational speed, it is advantageous that in the pulse start, a pulse-like rotational speed progression with a steeply rising edge is produced when the pulse starting clutch is engaged so that a reliable start of the engine is achieved.

In the known pulse starting method and the known device, it is disadvantageous that the starting system must be designed for high output. Particularly because a reliable start must be assured for every operating state of the engine. This high starter output is particularly required with increasing cold because the drag power to be exerted by the starter increases and the starter battery power decreases. In comparison to the conventional starter system, this problem is even more pronounced in pulse starting because the drag power to be exerted by the electrical starter also increases with the rotational speed. The drag power also increases when an automatic transmission is provided to transmit torque into the drive train so that additional drag power must also be exerted for the converter input of the transmission. In addition to being designed based on output, known pulse starting methods and pulse starters are also designed so that a reliable start should be produced even with unfavorable rotational positions of the crankshaft of the engine. In the worst case, it can for example be necessary to rotate the crankshaft by 400° in order to achieve a synchronization of the engine required for the start. In particular, positions of the pistons and/or the valves should be determined in the synchronization. The injection of fuel and the ignition must take place in accordance with these positions. In addition, care must be taken in the pulse start that even with unfavorable initial operating positions and/or environmental parameters, the narrow time window for the starting of the engine can be preserved. This time window results in particular from the fact that when the pulse starting clutch is engaged, the rotational speed of the flywheel mass decreases very rapidly and thus the speed of the engine also remains lower, where a starting of the engine must be achieved at the latest by the point at which the speed of the engine falls below the minimal speed for startability. Since the drag moments increase at low temperatures, for example due to lower viscosity of the lubricants, this time window shrinks. Therefore, in order to assure a cold start, this window must be dimensioned based on a very high starting power, in particular also because in a start interruption, the uncertainty regarding the mixture state of the intake tube and individual cylinders, the chances for a successful second starting attempt decrease even further. An estimate of the starting power for a 3 liter, 6 cylinder engine with an automatic transmission, for example at an outside temperature of −25° C., yields a necessary wind-up rotational speed of the flywheel mass of approx. 1500 rpm, requiring the exertion of a drag moment of approximately 35 Nm. This yields the mechanical output of the starter of approx. 5.2 KW and thus a battery power of approx. 6.6 kW.

SUMMARY OF THE INVENTION

It is an object of the Invention to provide a pulse starting method for an internal combustion engine of the abovetype with a flywheel mass, which does not suffer from the above-described disadvantages, especially encountered during starting under cold conditions.

It is another object of the invention to provide a pulse starter for performing the method according to the invention.

According to the invention the pulse starting method for an internal combustion engine includes the following steps:

a) during a wind-up phase, accelerating a flywheel mass in a rotary driven fashion in order to rotate the flywheel mass;

b) then during a coupling phase following the wind-up phase, coupling the rotating flywheel mass to the crankshaft of the engine, in order transmit torque to the crankshaft for starting;

c) during at least one of the wind-up phase (15) and the coupling phase (21, 22), evaluating a rotational speed progression (n(t)) of the flywheel mass (3) to obtain evaluation results;

d) deducing whether a successful start of the engine is possible from the evaluation results obtained in step c); and e) if a successful start is not expected, the engine is brought into an operating position favorable for a subsequent starting attempt by means of the crankshaft.

According to the invention the pulse starter for the internal combustion engine, which has a crankshaft and a fly-wheel mass comprises an electrical starter for rotatably driving the flywheel mass;

a starter control unit for controlling the starter;

a pulse starting clutch for engaging the flywheel mass with the crankshaft to rotate the crankshaft in order to attempt to start the engine:

a rotation speed sensor for measuring a rotation speed of the flywheel mass and evaluating means for evaluating the rotational speed of the flywheel mass at individual times over time to determine whether or not a successful start of the engine is possible during successive starting attempts;

wherein the evaluating means includes means for evaluating at least one of a measured rotation speed of the flywheel mass and a rotational speed progression of the flywheel mass, during at least one of a wind-up phase in which the flywheel mass is put into rotation, but not coupled to said crankshaft, and a coupling phase in which the flywheel mass is coupled with the crankshaft to start the engine in order to obtain evaluation results.

ADVANTAGES OF THE INVENTION

The pulse starting method according to the invention and the pulse starter according to the invention have the advantage over the prior art that they permit a considerable reduction of the starting power required to assure a start during pulse starting. Particularly due to the fact that a rotational speed monitor evaluates the rotational speed progression of the flywheel mass during the wind-up phase and/or the coupling phase, a determination can be made as to whether the available starting power, which is reduced in comparison to the prior art, is sufficient to start the engine In a first starting attempt. If this is not the case, then the rotary accelerated flywheel mass and/or the electrical starter at least brings the engine into an operating position that is favorable for a subsequent second starting attempt. Particularly in cold starting conditions during a first cranking of the engine, the drag power for a subsequent second starting attempt can be reduced since the first cranking produces a lubrication of the moving parts in the engine and/or the connected transmission. In particular with automatic transmissions, it has turned out that a few revolutions are sufficient to reduce the drag power at the converter input. Consequently, less drag power is required for the second subsequent starting attempt so that also due to the adjustment of the favorable operating position of the engine for the second starting attempt, a significantly lower starting power is required, but a more reliable start can be achieved. If the rotational speed progression of the flywheel mass is evaluated during the wind-up phase, a determination can also be made as to whether the starter battery can produce enough power. However, if the rotational speed progression indicates that it will not be possible to bring the flywheel mass to the required speed, then the coupling phase can be initiated ahead of time and the engine can be brought into an operating position that is favorable for the second starting attempt. The first cranking during the first starting attempt already reduces the drag moment in this instance as well so that the subsequent second starting attempt also succeeds with a lower power.

The pulse starting method and pulse starter according to the invention also offer the advantage that no additional hardware components have to be produced. Normally during the pulse starting of an engine, the pulse starting clutch is only engaged when the flywheel mass has achieved a particular speed. It is provided with a speed sensor anyway. Its signal can naturally also be used to assess the rotational speed progression with the method according to the invention or with the pulse starter according to the invention. In order to be able to adjust or produce the favorable operating position of the engine, here too, modern engines are already provided with existing transmitters, in particular rotational speed transmitters, which can detect e.g. the rotational position of the crankshaft and/or camshaft and/or the piston position. In modern engines, these values are required for the control and/or regulation of the combustion process. Consequently, the signal of these transmitters can also advantageously be evaluated with the pulse starting method according to the invention or with the pulse starter.

In order to be able to assess the rotational speed progression of the flywheel mass, the gradient of the rotational speed progression must be monitored during the wind-up phase, and in the event of an insufficient gradient, as mentioned above, the coupling phase is initiated so that the engine can still be brought into the operating position that is favorable for the second starting attempt.

Alternatively or in addition, the level of the rotational speed of the flywheel mass can be detected at predeterminable times in order to evaluate or assess the rotational speed progression; here, too, in the event of an insufficient rotational speed level at a particular time, the coupling phase is initiated.

If the pulse starting clutch is engaged early during the wind-up phase, preferably no starting attempt at all is undertaken in the sense that an activation of the ignition and/or an injection takes place in the engine. A this assures that no uncontrolled mixture states occur in the intake conduit of the engine.

If an insufficient gradient of the rotational speed curve in his detected during the coupling phase and/or an insufficient rotational speed of the flywheel mass is detected at a particular time, the starting attempt is interrupted early, i.e. the triggering of the electrical starter is stopped, but preferably only when the engine has assumed the operating position that is favorable for the second starting attempt. It is therefore possible during the coupling phase as well, for the electrical starter to continue to drive and/or brake the flywheel mass in order to be able to stop the engine in a particular desired operating position or bring it into a desired position.

According to a modification of the invention, in the event of a start interruption, at least the synchronization of the engine is still carried out, during which time the piston position and/or the valve position of the engine is detected. Typically, a rotation of the crankshaft by 200° is sufficient in order to be able to determine the piston positions and/or the valve positions of the engine. In an unfavorable case, a 400° crankshaft rotation may also be required in order to carry out the synchronization.

In order to be able to improve the assessment and/or evaluation of the rotational speed progression of the flywheel mass, preferably other starting parameters are taken into consideration. For example, these include the outside temperature, the operating temperature of the engine, and the charge state of the starter battery.

To achieve an improved second starting attempt, it is possible for the on-board battery of a motor vehicle to recharge the starter battery between the first and second starting attempt. As a result, it is possible to increase the output to be exerted by the electrical starter.

In order to bring the engine into the operating position that is favorable for the second starting attempt, it is particularly possible for influence to be exerted on the engine as it comes to rest. This is possible, for example, by means of the electrical starter which drives the flywheel mass. In addition to its driving function, the electrical starter can also have a braking function. Because of this, the electrical starter is preferably embodied as a so-called starter generator which supplies the electrical system of the motor vehicle with electrical energy when the engine is running. For the favorable operating position, it is particularly possible for at least one piston to be brought into a stroke position from which, after an introduction of fuel into the combustion chamber, a combustion of this fuel can be achieved, i.e. a working stroke of the piston can be produced so that a first assisting combustion in the engine can be achieved, in fact before the speed of the engine falls below the starting limit requirement, which can be estimated at approximately 80 rpm.

Other advantageous embodiments ensue from the dependent claims.

DRAWINGS

Exemplary embodiments of the invention will be explained in detail below in conjunction with the drawings.

DESCRIPTION OF THE EXEMPLARY EMBODIMENTS

Figure 1:
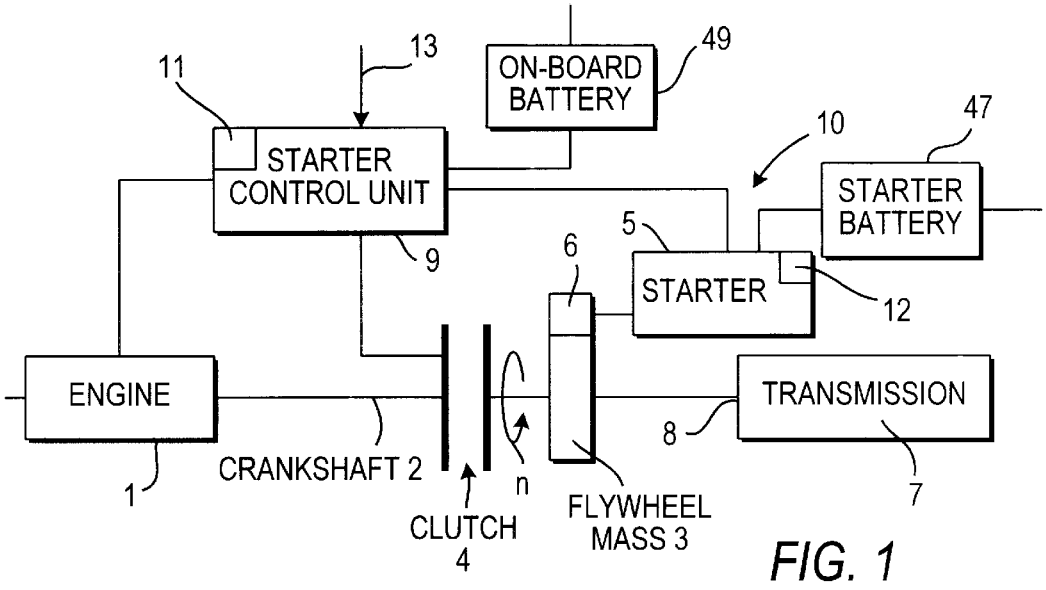
FIG. 1 is a block circuit diagram of a pulse starter.

FIG. 1 is a block circuit diagram of an internal combustion engine 1, which can include at least one reciprocating piston, not shown here, with associated valves, where the reciprocating piston drives a shaft, in particular a crankshaft 2, which drives the engine. Between a rotatably supported flywheel mass 3 and the crankshaft 2, there is an intrinsically known pulse starting clutch 4 so that the flywheel mass 3 can be coupled to the crankshaft 2. The flywheel mass 3 is driven to rotate by an electrical starter 5. The flywheel mass 3 and starter 5 can have a starter drive 6 disposed between them, which is preferably embodied with multiple stages. The starter 5 is preferably a so-called starter generator. In order to drive a motor vehicle that is not shown here, a rotational speed transmission means 7 is also provided, whose drive input 8 can be connected to the crankshaft 2. The rotational speed transmission means 7 is preferably embodied as an automatic transmission. However, it can also be an intrinsically known shift transmission.

The electrical starter 5 is triggered by a starter control unit 9. The starter control unit 9 likewise controls the opening and closing of the pulse starting clutch 4. The starter control unit 9 detects signals from sensors disposed in the engine, which detect, for example, the rotational position of the crankshaft 2 and/or a camshaft, not shown, and/or the temperature of the engine 1. The electrical starter 5 and the starter control unit 9 constitute a pulse starter 10 in which the electrical starter 5 accelerates the flywheel mass 3 to a predeterminable rotational speed n. If the rotational speed n achieves a wind-up rotational speed $n_{ref}$ required to start the engine 1, then the starter control unit 9 triggers the pulse starting clutch 4 so that it is engaged and the crankshaft 2 is accelerated by the flywheel mass 3. The starter control unit 9 disengages the pulse starting clutch before a new wind-up process, i.e. an acceleration of the flywheel mass 3 should occur.

During the wind-up phase of the flywheel mass 3 to the wind-up rotational speed $n_{ref}$, an evaluation circuit 11 preferably associated with the starter control unit 9 monitors the rotational speed progression of the flywheel mass 3. The evaluation circuit 11 can determine the level of the rotational speed of the flywheel mass 3 at particular predeterminable times. However, it is also possible for a rotational speed curve to be determined over time, where the gradient of the curve can be detected at presettable times. Preferably, the rotational speed n of the flywheel mass 3 is determined by means of a rotational speed sensor 12, which is disposed in the starter 5 and whose measurement signal is detected by the evaluation circuit 11. At least a first starting procedure can be manually triggered by means of an activation input 13.

A starter battery 47 connected to the starter 5 for making starting attempts can be recharged in some embodiments with an on-board battery 49 under control of the controller 9.

Figure 2:
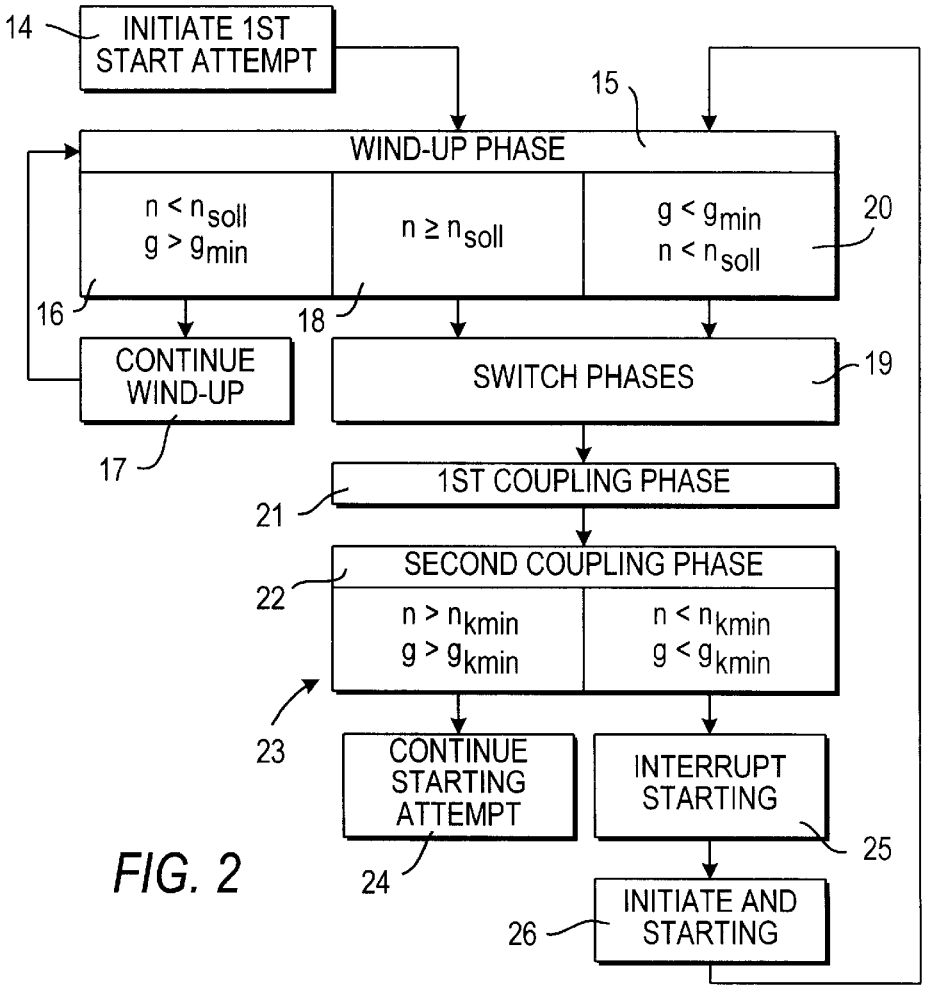
FIG. 2 is a flow chart of a pulse starting method.

The flow chart depicted in FIG. 2 shows a pulse start of the engine 1 with up to two wind-up phases. The starting initiation 14 is triggered by means of the activation input 13. The starter control unit 9 activates the electrical starter 5, which drives the flywheel mass 3 during the wind-up phase 15. During the wind-up phase 15, the evaluation circuit 11 monitors the rotational speed n of the flywheel mass 3 to determine whether the rotational speed n is less than the wind-up rotational speed $n_{ref}$. Alternatively or in addition, a determination is made as to whether the gradient g of the rotational speed curve is greater than a predeterminable minimal gradient $g_{min}$. If these two conditions listed in the deciding step 16 are fulfilled, then the decision is made in the starter control unit 9 that the wind-up phase should be continued, as indicated by the process step 17.

If the rotational speed sensor 12 determines that the rotational speed n is greater than or equal to the wind-up rotational speed (step 18), then the wind-up phase is ended and the pulse starting clutch 4 is engaged, which is indicated by method step 19. The evaluation circuit 11 also determines whether the gradient g of the rotational speed curve is less than the predeterminable minimal gradient $g_{min}$. If in addition, the rotational speed n is less than the reference rotational speed $n_{ref}$ (step 20), then the pulse starting clutch 4 is likewise engaged, i.e. a switch over to the method step 19 is made. Method step 19 is followed by the first coupling phase 21 in which the synchronization with the engine 1 is carried out. During the synchronization, the positions of the pistons and the valves of the engine 1 are detected. The synchronization is achieved and ended in the subsequent second coupling phase 22. During the second coupling phase 22, through extrapolation of the rotational speed curve detected by the evaluation circuit 11, possibly including the gradient g, an assessment is made to as to whether it is possible for there to be at least one combustion event above the startability limit of the engine 1 (minimal rotational speed at which a start can be expected). In this method step 23, an assessment is made as to whether the rotational speed n is greater than or equal to a minimal rotational speed $n_{kmin}$, which represents a minimal rotational speed during the coupling phase. In addition, the gradient g can be compared to a limit value for the gradient $g_{kmin}$ of the rotational speed curve during the coupling phase. If the rotational speed n and/or the gradient g is/are greater than the comparison values $n_{kmin}$ and/or $g_{kmin}$, then the starting is continued in method step 24. If the rotational speed is too low or the rotational speed decrease (gradient) is too great, i.e. if the rotational speed curve n(t) has too great a negative slope, then the first starting attempt is interrupted in method step 25. As the engine is coming to rest, the crankshaft 2 is preferably brought to a halt in a rotational position which corresponds to an operating position of the engine 1 that is favorable for a second starting attempt. In the favorable operating position, it is preferably possible for at least one piston of the engine 1 to be disposed in such a position that in its associated cylinder, a combustion event can be initiated or started immediately afterward. If the engine 1 has come to a stop, the pulse starting clutch 4 is disengaged during method step 25. A second starting attempt can then be initiated (method step 26), i.e. a new wind-up phase 15 can be started. Since the engine 1 is in an operating position that is favorable for the second start, immediately before the end of the second wind-up phase 15 and before the beginning of the second coupling phase 22, fuel can be injected into a cylinder of the engine so that during the second coupling phase 22, a reliable start can be produced. In the second starting attempt, method step 21, i.e. the synchronization of the engine, can be omitted if so desired. It is also possible for no fuel injection and/or ignition to occur after the interruption of the first start during method step 25.

During the first starting attempt in method step 20, if it is determined that the gradient g and/or the rotational speed n is too low, then the crankshaft 2 of the engine 1 can still be driven to rotate for a particular, predeterminable time, wherein a corresponding rotational speed is also maintained, which is produced, for example, from the starter rotational speed under load. In particular in the event of a cold start, this assures that the movable parts in the engine and in the rotational speed transmission means 7 are lubricated, which achieves an overall reduction of the drag power that the electrical starter must exert. As a result, during the second starting process, the friction loss in the engine 1 and in the rotational speed transmission means 7 is reduced so that both the wind-up rotational speed and the speed of the engine when the pulse starting clutch is engaged are increased, which increases the starting reliability.

Figure 3:
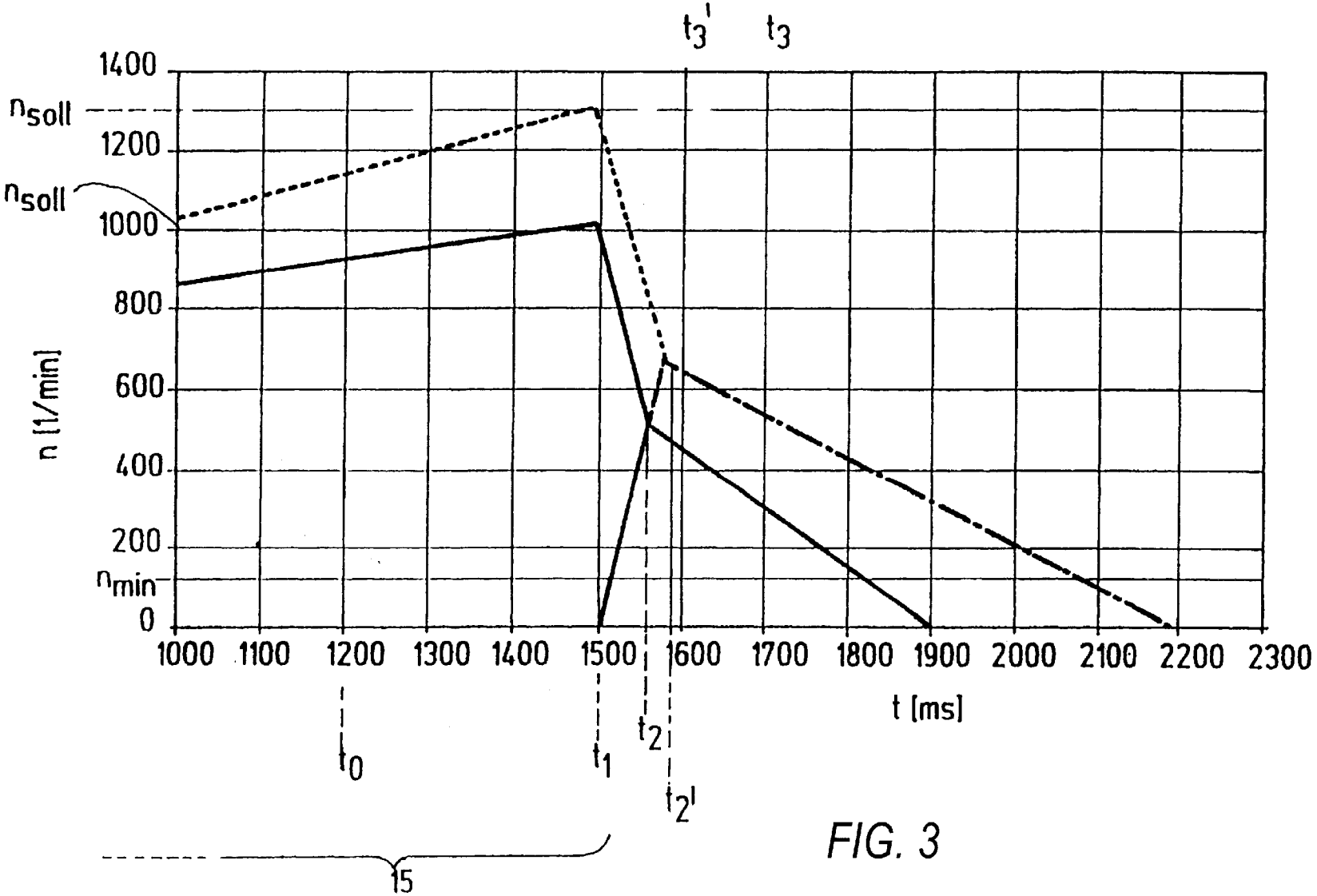
FIG. 3 shows a rotational speed progression of an internal combustion engine in a second starting attempt.

FIG. 3 shows two rotational speed curves of the flywheel mass 3 over time t during a second starting attempt. The upper curve of the rotational speed progression was determined during the second starting process, where in the start interruption, the engine 1 and its crankshaft 2 were driven long enough for a reduction in the friction loss to occur. This additional step was not taken in the lower rotational speed curve.

The progression of the curves will be explained in more detail below: The wind-up phase 15 of the flywheel mass 3 occurs up to time t1. At time t1, the first coupling phase 21 is then initiated, in which the pulse starting clutch 4 is engaged. It is clear from the curves that when the pulse starting clutch is engaged at time t1, the rotational speed of the crankshaft 2 increases until time t2 and t2' and the rotational speed of the flywheel mass decreases. At time t2 and t2', then, there is no slippage between the crankshaft-side clutch part and flywheel-side clutch part so that the pulse starting clutch 4 is thus completely engaged. Because the flywheel mass 3 has imparted its rotational energy to the engine, the rotational speed n of the flywheel mass 3 decreases and therefore so does the speed of the crankshaft 2. At the beginning of this decreasing rotational speed curve section, during the second start at time t3 (lower rotational speed curve) and at time t3' (upper rotational speed curve), the first assisting combustion is possible. It therefore turns out that the first assisting combustion can be activated at time t3 or t3', before the minimal rotational speed $n_{min}$ of the engine 1 is achieved, where it is possible for a preinjection of fuel into the cylinder of the engine to occur during the time interval from t0 to t1. It therefore turns out that in both instances, there is a sufficient safe distance between the first assisting combustion and the minimal rotational speed $n_{min}$ so that the engine 1 can thus be reliably started at least during the second starting attempt.

What is claimed is:

1. A pulse starting method for an internal combustion engine having a crankshaft, said method comprising the steps of:

a) during a wind-up phase, accelerating a flywheel mass in a rotary driven fashion in order to rotate the flywheel mass;

b) then during a coupling phase following the wind-up phase, coupling the rotating flywheel mass to the crankshaft of the engine, in order transmit torque to the crankshaft for starting the engine;

c) during at least one of the wind-up phase (15) and the coupling phase (21, 22), evaluating a rotational speed progression (n(t)) of the flywheel mass (3) to obtain evaluation results;

d) deducing whether a successful start of the engine is possible from the evaluation results obtained in step c); and e) if said successful start is not expected, the engine is brought into an operating position favorable for a subsequent starting attempt by means of the crankshaft.

2. The pulse starting method according to claim 1, wherein during the wind-up phase (15), said evaluating includes determining a gradient (g) of said rotational speed progression (n(t)) of the flywheel mass (3) and initiating said coupling phase (21, 22), if said gradient is less than a predetermined minimum gradient value.

3. The pulse starting method according to claim 1, wherein during the wind-up phase (15), measuring a rotation speed (n) of the flywheel mass (3) at predetermined times (t) for said evaluating and initiating the coupling phase (21, 22), if said rotation speed is greater than a predetermined minimum speed value at a particular one of said predetermined times (t).

4. The pulse starting method according to claim 1, wherein during the coupling phase, said evaluating includes determining a gradient (g) of said rotational speed progression (n(t)) of the flywheel mass (3), interrupting a starting attempt if said gradient is excessively negative and bringing the engine (1) into an operating position favorable for another starting attempt.

5. The pulse starting method according to claim 1, wherein during the coupling phase, measuring a rotation speed (n) of the flywheel mass (3) at predetermined times (t) for the evaluating, interrupting a starting attempt at a particular one of said predetermined times (t), if said rotation speed (n) is less than a predetermined rotation speed threshold value, and bringing the engine (1) into an operating position that is favorable for another starting attempt.

6. The pulse starting method according to claim 1, wherein said engine comprises a plurality of pistons and cylinders in operative connection with said crankshaft and in said operating position of said engine favorable for starting at least one of said pistons is disposed In an associated cylinder so that a combustion event can occur in said associated cylinder immediately at initiation of a further starting attempt.

7. The pulse starting method according to claim 1, further comprising synchronizing the engine if a starting process is interrupted and wherein said synchronizing includes at least one of determining piston position and valve position.

8. The pulse starting method according to claim 1, wherein said evaluating includes taking additional start parameters into account during evaluation of the rotational speed progression (n(t)).

9. The pulse starting method as defined in claim 8, wherein additional start parameters include at least one of an outside temperature, an operating temperature of the engine and a charge state of a starter battery.

10. The pulse starting method according to claim 1, wherein at least one of fuel injection and ignition does not occur while the engine (1 ) is being brought into the operating position that is favorable for the subsequent starting attempt.

11. The pulse starting method according to claim 1, wherein, if successful starting is not expected during a first starting attempt, the crankshaft (2) drives the engine (1) for a predetermined time at a predetermined rotation speed (10) before bringing the engine into the operating position that is favorable for said subsequent starting attempt.

12. The pulse starting method according to claim 1, wherein after a start interruption, influence is exerted on the engine as the engine comes to rest in order to bring the engine into the operating position that is favorable for said subsequent starting attempt.

13. The pulse starting method according to claim 1, further comprising recharging a starter battery (47) employed for said starting attempts with an on-board battery (49) of a motor vehicle under control of a controller (9) comprising means for said deducing.

14. A pulse starter for an internal combustion engine (1) having a rotatably supported crankshaft (2) and a rotatably supported fly-wheel mass (3), the pulse starter (10) comprising an electrical starter (5) for rotatably driving said flywheel mass (3);

a starter control unit (9) for controlling said starter (5);

a pulse starting clutch (4) for engaging said flywheel mass (3) with said crankshaft (2) to rotate said crankshaft in order to attempt to start said engine;

a rotation speed sensor (12) for measuring a rotation speed of said flywheel mass (3), and evaluating means (11) for evaluating said rotational speed (n) of said flywheel mass (3) at individual times over time (t) to determine whether or not a successful start of said engine (1) is possible during successive starting attempts;

wherein said evaluating means includes means for evaluating at least one of a measured rotation speed of said flywheel mass and a rotational speed progression of the flywheel mass (3), during at least one of a wind-up phase (15) in which said flywheel mass (3) is put into rotation, but not coupled to said crankshaft, and a coupling phase (21, 22) in which said flywheel mass is coupled with said crankshaft to start said engine in order to obtain evaluation results.

15. The pulse starter as defined in claim 14, wherein said evaluating means includes means for activating said pulse starting clutch to initiate said coupling phase during the wind-up phase according to said measured rotation speed and, if a gradient of said rotational speed progression is less than a predetermined minimum gradient value.

* * * * *